US005937780A

United States Patent [19]

Etheridge et al.

[11] Patent Number: 5,937,780

[45] Date of Patent: Aug. 17, 1999

[54] DOUBLE POINT MOORING SYSTEM

[75] Inventors: Charles O. Etheridge; Martin J. Kraft; Brent A. Salyer, all of Houston, Tex.

[73] Assignee: FMC Corporation, Chicago, Ill.

[21] Appl. No.: 09/103,065

[22] Filed: Jun. 23, 1998

[51] Int. Cl.[6] ..... B63B 21/50

[52] U.S. Cl. ..... 114/230.2; 114/293

[58] Field of Search ..... 114/230, 293, 114/230.2, 230.22, 230.23, 230.24; 441/3–5

[56] References Cited

U.S. PATENT DOCUMENTS

| | | |
|---|---|---|
| 716,059 | 12/1902 | Lake . |
| 3,236,267 | 2/1966 | Bily . |
| 3,335,690 | 8/1967 | Busking . |
| 3,585,959 | 6/1971 | Cook et al. . |
| 3,886,882 | 6/1975 | Thornburg et al. . |
| 5,170,737 | 12/1992 | Poldervaart . |

FOREIGN PATENT DOCUMENTS

| | | | |
|---|---|---|---|
| 0018486 | 1/1985 | Japan | 114/230 |
| 1194371 | 2/1967 | United Kingdom | 114/230 |

*Primary Examiner*—Ed L. Swinehart
*Attorney, Agent, or Firm*—Bush, Riddle & Jackson, L.L.P.

[57] ABSTRACT

A spread mooring arrangement is provided for use in deep water (greater than 200 meters) when it is advantageous to maximize the clearance between shuttle tankers used for product offloading and the anchor legs associated with a spread mooring of the permanently moored tanker. Mooring insert tubes are provided at the bow and stern of the vessel. Bow mooring lines extend from the sea floor, through an opening of the bottom of the hull of the vessel and via a bow mooring insert tube for securement on a chain pull-up deck. Stern mooring lines extend from the sea floor through an opening in the bottom of the hull of the vessel and via a stern mooring insert tube for securement on a chain pull-up deck. Space is available on one side of the vessel for a porch for securement of production risers, work over risers and control umbilicals, thereby providing flexibility of the use of the vessel for the circumstance where production methods for the oil filled change during its lifetime or where other fields need to be coupled to the vessel with risers.

11 Claims, 3 Drawing Sheets

DOUBLE POINT MOORING SYSTEM

CROSS REFERENCE TO RELATED APPLICATION

This application claims the priority filing date of U.S. Provisional application 60/051,959 filed Jul. 8, 1997.

BACKGROUND OF THE INVENTION

Field of the Invention

This invention relates in general to mooring arrangements for vessels and in particular to a spread mooring arrangement for a permanently moored storage vessel to which a shuttle tanker is tied up along side during product transfer.

Description of the Prior Art

A shuttle tanker tied up beside a permanently moored storage tanker needs clearance between its hull and the anchor legs of the storage tanker.

There are many permanent mooring arrangements for storage tankers yet, a possibility exists for shuttle tanker entanglement with anchor legs of the permanently moored vessel, especially if anchor legs are secured mid-way between its stern and its bow or if anchor legs are secured mid-way between its stern and its bow or if anchor legs extend from the deck via the side of the vessel.

Identification of Objects of the Invention

It is an important objective of the invention to provide a mooring arrangement for permanently mooring a storage tanker in deep water (greater than 200 meters) which substantially prevents the possibility of entanglement of the shuttle tanker with the anchor legs of the storage tanker.

Another object of this invention is to provide a spread mooring at the bow end and the stern end of the vessel to allow large shuttle vessels to be tied up alongside the storage vessel in moderate environments for offloading of hydrocarbon product without the potential to entangle the permanently installed anchor legs of the storage vessel.

Another object of this invention is to provide a double point mooring system for large vessels to be tied up together in moderate environments for offloading product from one vessel to another while providing space on the side of the storage vessel for the securement of production risers, work over risers or control umbilicals.

SUMMARY OF THE INVENTION

In shallow water, spread mooring systems have been used. The anchor legs of such spread mooring systems have normally been deployed from a top deck of the vessel from its sides, bow or stern. Placement of such spread anchor legs is likely to cause entanglement of a shuttle tanker when it is maneuvered for tying up the side of the storage vessel.

According to the invention, a double spread mooring system is provided, one at the stern, the other at the bow of the storage vessel for deep water (greater than 200 meters) applications. Such placement of anchor legs away from mid-way between stern and bow provides a certain level of clearance of a shuttle tanker tied up to the side of the storage vessel. The bow and stern anchor legs enter the vessel not from the deck of the bow or stern or from its sides, but rather from beneath the vessel via a mooring insert tube through which anchor chains are pulled in from winches on the deck of the vessel. Because the anchor legs approach the vessel from the bottom of its keel, a further level of clearance is provided for deep water applications, which substantially insure that a shuttle tanker will not become entangled with the anchor legs.

BRIEF DESCRIPTION OF THE DRAWINGS

The various objects and advantages of this invention will become apparent to those skilled in the art upon an understanding of the following detailed description of the invention, read in light of the accompanying drawings which are made a part of this specification and in which.

In the Drawings.

DESCRIPTION OF THE PREFERRED EMBODIMENT OF THE INVENTION

Figure 1:
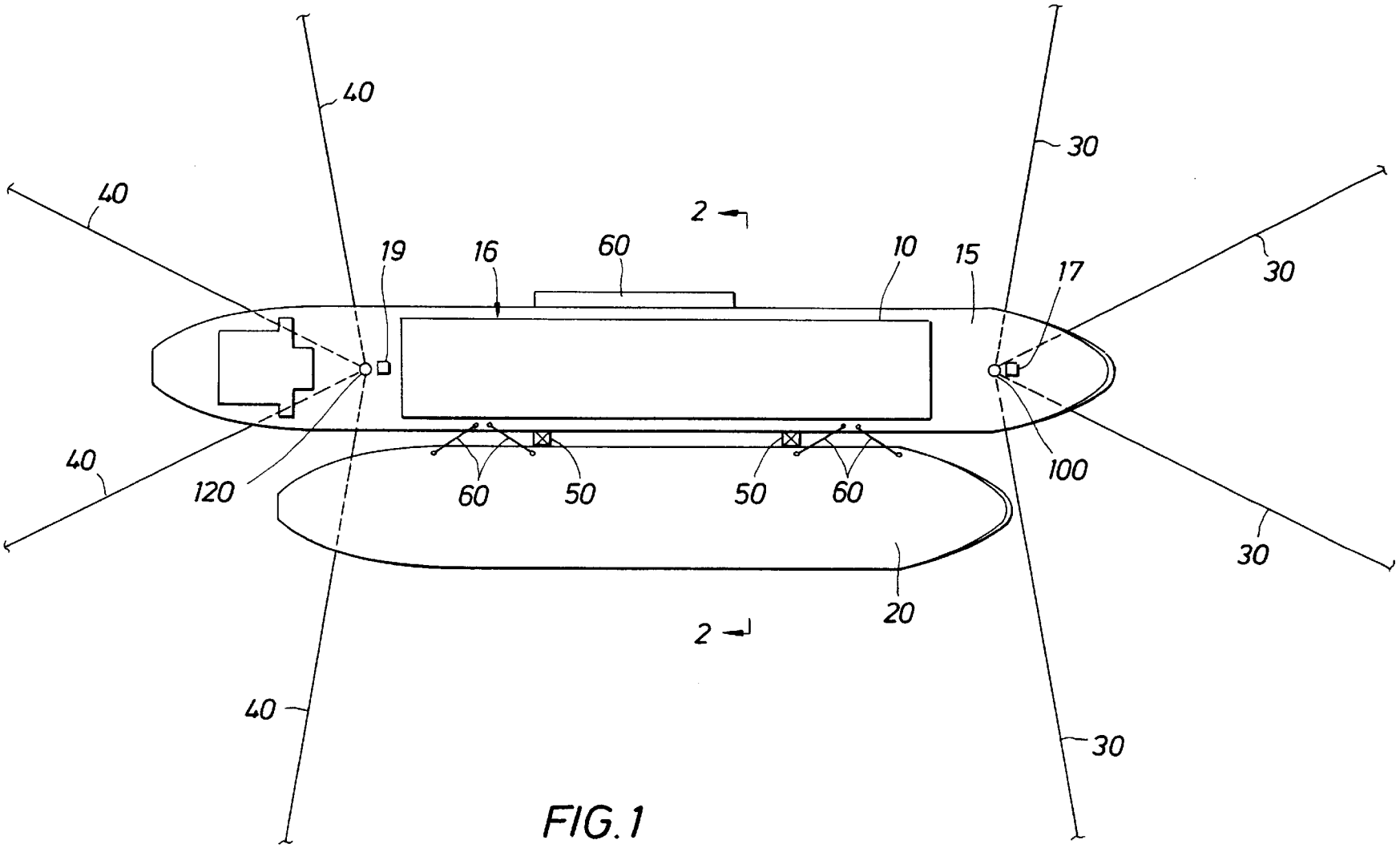
FIG. 1 is a plan view of a permanently moored vessel with a double point mooring arrangement according to the invention with a shuttle tanker tied up along its side.

A plan view is presented in FIG. 1 of a permanently moored storage vessel 10 having a shuttle tanker 20 (shown fully loaded) tied up along its side for loading of product. Rubber fenders 50 protect the vessels from damage while being tied to each other. Flexible hoses 60 provide product flow paths from the permanent storage vessel 10 and the shuttle tanker 20.

The storage vessel 10 is moored to the sea bed by a double spread mooring arrangement comprising anchor legs 30 at the bow and anchor legs 40 at the stern rather than a single anchor leg pattern connected mid-way between bow and stern. The anchor legs are terminated at the sea floor by anchors. Such anchors may be of any of several known types in the art of mooring systems. Anchor legs 30 may include lengths of chain and wire or synthetic rope as well known in the art of mooring systems.

Anchor legs 30 at the bow are secured to vessel 10 by entering at a bottom end of a bow insert tube 100 which is placed on the longitudinal center line of the hull of the vessel and extends from the vessel deck 15 (or a chain pull-up deck) to the keel of the vessel. Each anchor leg 30 is pulled in and secured to the chain pull-up deck 15 of the vessel 10 by a double drum winch 17. Likewise, anchor legs 40 at the stern are secured to vessel 10 by entering at a bottom end of a stern insert tube 120 which is similar in construction to tube 100. Each anchor leg 40 is pulled in and secured to the chain pull-up deck 15 of the vessel 10 by a double drum winch 19. Different chain pull-up decks may be used under certain circumstances.

Figure 2:
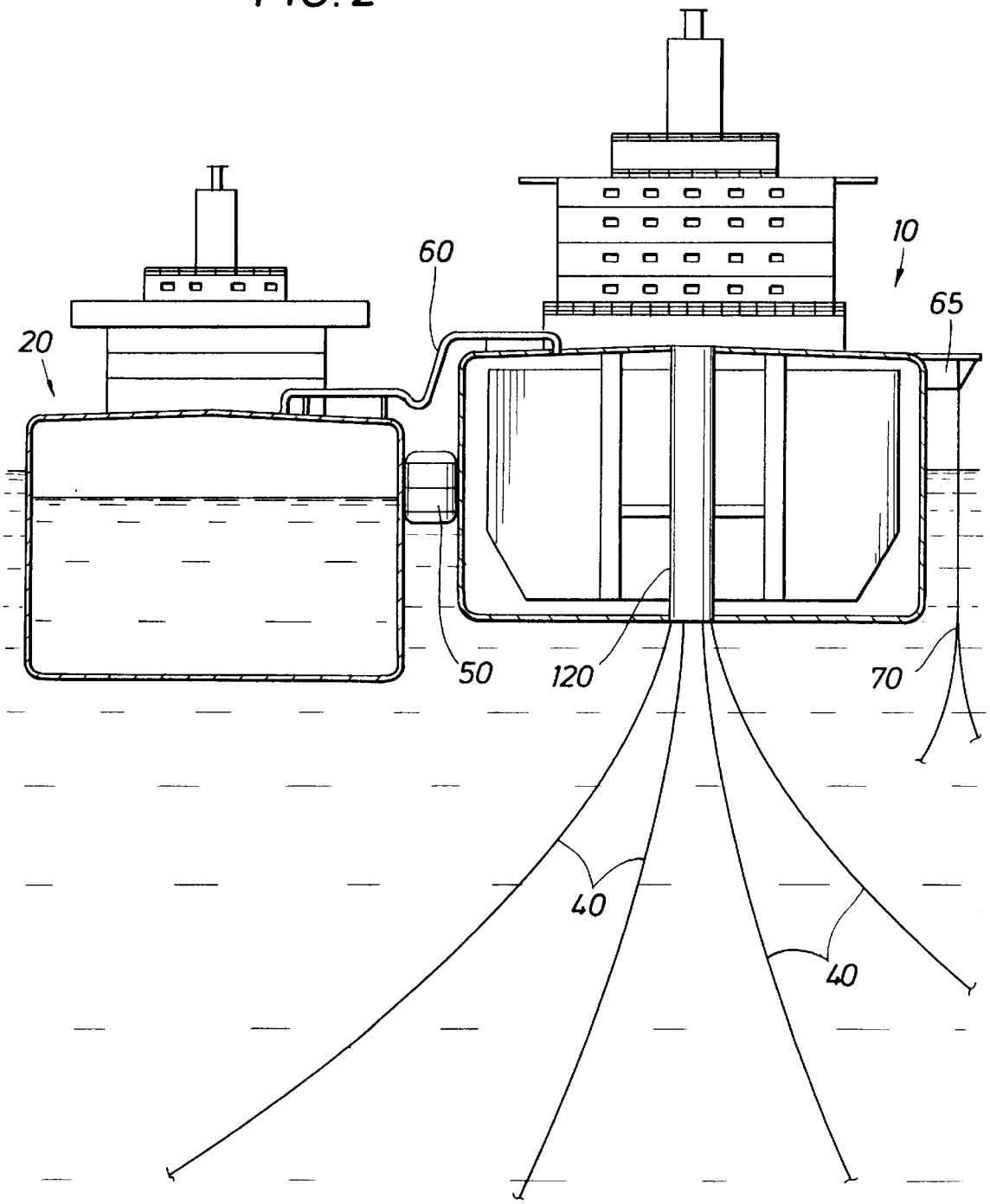
FIG. 2 is a cross sectional view taken along sections lines A—A of FIG. 1 which illustrates anchor legs at the stern of the vessel entering a mooring insert tube of the vessel.

FIG. 2 illustrates the two vessels 10 and 20 in a cross-section view along lines A—A of FIG. 1. Because anchor legs 40 enter the insert tube 120 from beneath the permanently moored vessel 10, rather than from its side or the top of its bow or stern, and because the anchor legs 30 and the anchor legs 40 are connected to storage vessel 10 at its bow and stern, not mid-way between bow and stern, the shuttle tanker 20 has sufficient clearance from anchor legs 40 and anchor legs 30 to insure that there will not be entanglement.

The section view of FIG. 2 further illustrates a riser porch 65 provided along the side opposite that to which the shuttle tanker 20 is tied up. Riser porch 65 provides a structure where production risers and control umbilicals 70 may be run and secured to the permanently moored vessel 10. Such riser porch 65 may be provided mid-way between stern and bow. Advantageously, the riser porch placed to the side of the permanently moored vessel 10 provides a large area for the combination of risers for production, re-injection or control umbilicals. This allows great flexibility and adaptability for the installation of such equipment in the event that production methods for the oil field were to change during its lifetime or in the event that adjacent production wells were to be required to be serviced by the vessel 10.

FIG. 1 illustrates that a large deck space 16 is available for production processing equipment even where two mooring insert tubes 100, 120 are provided.

Figure 3:
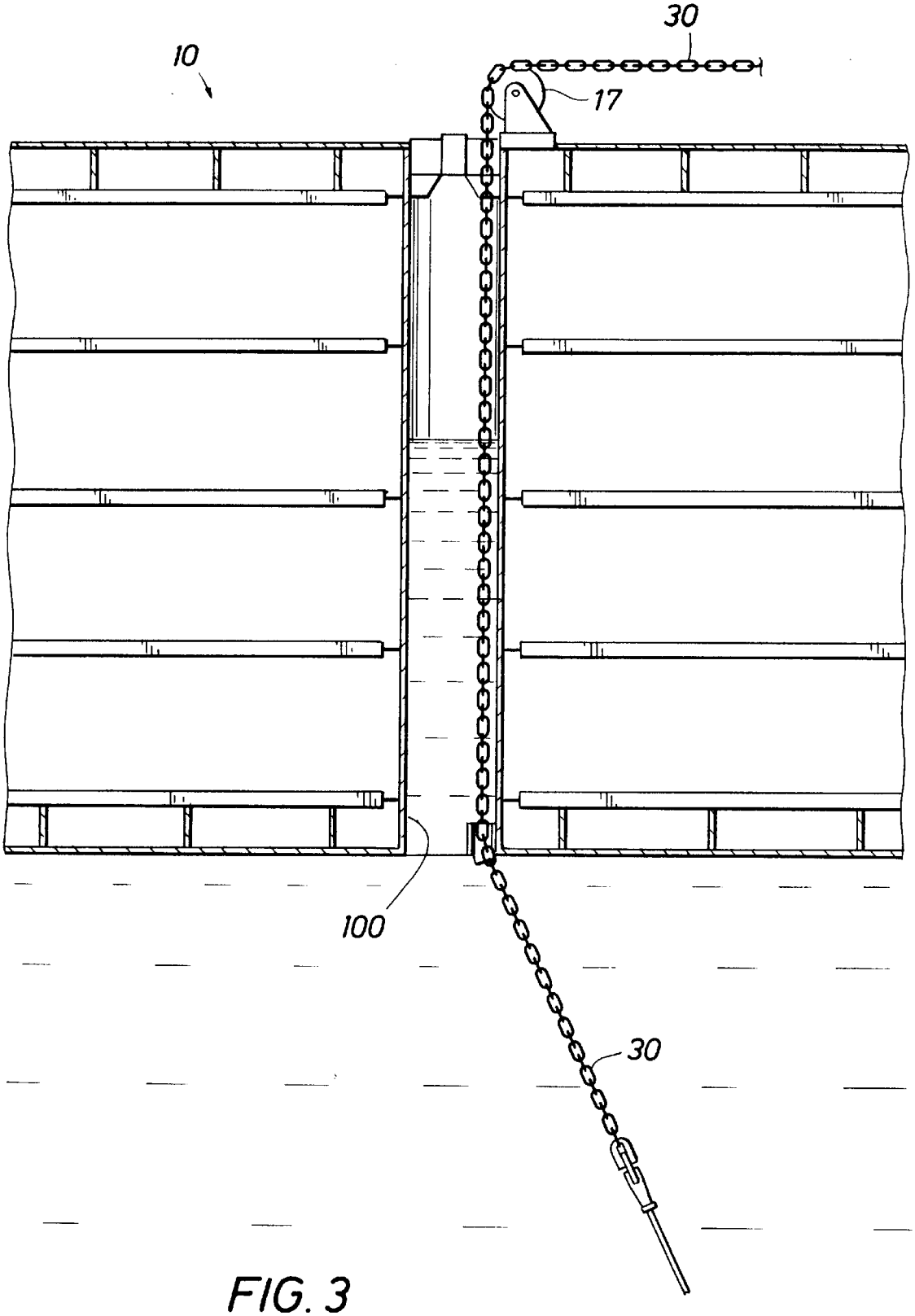
FIG. 3 illustrates the mooring insert tube of the mooring arrangement of the invention.

FIG. 3 illustrates an anchor leg 30 being spooled onto the vessel by a drum winch 17. Each mooring insert tube assembly 100, 120 is welded into an existing tanker 10 structure, typically at an intersection of longitudinal and transverse bulkheads. The internal diameter of the mooring tubes may be three meters, for example. Typically four anchor legs per tube are provided as illustrated in FIGS. 1 and 2. This arrangement maintains the integrity of the tanks of the vessel and provides a way to introduce mooring loads into the tanker.

The drum winches 17, 19 are preferably double drum winches to facilitate the hook up of the anchor legs 30 or 40 as the case may be. A chain-wire-chain anchor leg arrangement is illustrated in FIG. 3, but of course other arrangements may be provided.

Although, the preferred embodiment of the double point mooring arrangement of FIGS. 1–3 is for a shuttle tanker 20 to be tied up along the side of the permanently moored vessel 10, the arrangement may be used for offloading systems at the bow and or stern of the vessel to better facilitate off loading. The same advantages of providing large clearance distances between the anchor legs 30, 40 and the off loading shuttle vessel reservoirs are achieved.

What is claimed is:

1. A storage vessel (10) having a hull with mooring arrangements at a bow end and at a stern end comprising, a bow mooring insert tube (100) disposed in said hull at said bow end, said bow mooring insert tube (100) extending from a bow chain pull-up deck of the vessel to the open sea at a bottom end;

a plurality of bow mooring lines (30) extending between said bow chain pull-up deck of the vessel, through the bow mooring insert tube (100) and to the sea floor;

a stern mooring insert tube (12) disposed in said hull at said stern end, said stern mooring insert tube extending from a stern chain pull-up deck of the vessel to the open sea at a bottom end; and a plurality of stern mooring lines (40) extending between said stern chain pull-up deck of the vessel through the stern mooring insert tube (120) and to the sea floor.

2. The storage vessel (10) of claim 1 further comprising, a riser porch (60) secured to a first side of said vessel and spaced between said bow mooring insert tube (100) and said stern mooring insert tube (120), said riser porch (60) arranged and designed for securement to said vessel of risers running between sub sea wells and the vessel.

3. The storage vessel of claim 1 wherein, production risers extend between sub sea wells and said vessel.

4. The storage vessel of claim 1 wherein, work over risers and control umbilical extend between sub sea wells and said vessel.

5. In combination with the storage vessel (10) of claim 2;

an offloading vessel, (20) secured to a second side of said storage vessel (10) wherein securement of said offloading vessel is placed between said bow mooring insert tube (100) and said stern mooring insert tube (120).

6. The storage vessel (10) of claim 1 further comprising, a drum winch (17) which is mounted on said vessel and is arranged and designed for pulling in said bow mooring lines (30).

7. The storage vessel (10) of claim 1 further comprising, a drum winch (19) mounted on said vessel and is arranged and designed for pulling in said stern mooring lines.

8. A storage vessel (10) characterized by a bow and a stern and floating on a body of sea water of a certain depth and having a hull with mooring arrangements at a bow end and at a stern end comprising, a plurality of bow mooring lines coupled to said vessel via a first opening in the bottom of the hull at said bow end of said vessel, said bow mooring lines extending to the sea floor;

a plurality of stern mooring lines coupled to said vessel via a second opening in the bottom of the hull at said stern end of said vessel, said stern mooring lines extending to the sea floor; and riser porch (60) secured to and extending outwardly of a side of said vessel between said stern mooring lines and said bow mooring lines.

9. In combination with the storage vessel (10) of claim 8;

an offloading vessel (20) secured to a side of said storage vessel (10) wherein securement of said offloading vessel (20) is disposed between said first opening and said second opening, whereby the probability of entanglement of said offloading vessel with said bow mooring lines of said storage vessel is decreased due to the coupling of said bow mooring lines and stern mooring lines at openings in the bottom of the hull of said storage vessel.

10. The storage vessel (10) of claim 8 wherein, said certain depth of said body of sea water is greater than 200 meters.

11. A storage vessel (10) characterized by a bow and a stern and floating on a body of sea water of a certain depth and having a hull with mooring arrangements at a bow end and at a stern end comprising, a plurality of bow mooring lines coupled to said vessel via a first opening in the bottom of the hull at said bow end of said vessel, said bow mooring lines extending to the sea floor;

a plurality of stern mooring lines coupled to said vessel via a second opening in the bottom of the hull at said stern end of said vessel, said stern mooring lines extending to the sea floor;

said first opening comprising the termination of a bow mooring insert tube (100) which extends from a bow chain pull-up deck of the vessel to the open sea at its bottom end;

said second opening comprising the termination of a stern mooring insert tube (120) which extends from a stern chain pull-up deck of the vessel to the open sea, and wherein;

said bow mooring lines (30) extending through said bow mooring insert tube (100) and secured to said vessel at said bow chain pull-up deck of the vessel all of said bow mooring lines extending from said vessel in at least a partially forward direction; and said stern mooring lines (40) extending through said stern mooring insert tube (120) and are secured to said vessel at said stern chain pull-up deck of the vessel, all of said stern mooring lines extending from said vessel in at least a partially rearward direction.

* * * * *

UNITED STATES PATENT AND TRADEMARK OFFICE

CERTIFICATE OF CORRECTION

PATENT NO. : 5,937,780

DATED : August 17, 1999

INVENTOR(S) : Charles O. Etheridge; Martin J. Kraft; Brent A. Salyer

It is certified that error appears in the above-identified patent and that said Letters Patent is hereby corrected as shown below:

Title page, item [75], ln. 2, delete "Kraft", insert – Krafft--

Signed and Sealed this

Eighth Day of August, 2000

*Attest:*

Q. TODD DICKINSON

*Attesting Officer*

*Director of Patents and Trademarks*